US010329791B1

(12) United States Patent
Cauley, Jr. et al.

(10) Patent No.: US 10,329,791 B1
(45) Date of Patent: Jun. 25, 2019

(54) STOWABLE TIE DOWN STAKE

(71) Applicant: BATTENFELD TECHNOLOGIES, INC., Columbia, MO (US)

(72) Inventors: Dennis W. Cauley, Jr., Booneville, MO (US); James Tayon, Moberly, MO (US); Michael Cottrell, Columbia, MO (US); Timothy Kinney, Warrenton, MO (US); James Gianladis, Harrisburg, MO (US); Michael Poehlman, Columbia, MO (US); Mark Dalton, Columbia, MO (US); Joel Yuodsnukis, Columbia, MO (US); Matthew Kinamore, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 5 days.

(21) Appl. No.: 15/873,625

(22) Filed: Jan. 17, 2018

(51) Int. Cl.

| | |
|---|---|
| ***A47B 97/00*** | (2006.01) |
| ***E04H 15/62*** | (2006.01) |
| ***E02D 5/80*** | (2006.01) |

(52) U.S. Cl.
CPC ..... *E04H 15/62* (2013.01); *E02D 5/80* (2013.01)

(58) Field of Classification Search
CPC ..... E04H 15/62; E04H 12/223
USPC ..... 248/508, 507, 530
See application file for complete search history.

(56) References Cited

U.S. PATENT DOCUMENTS

| | | | | |
|---|---|---|---|---|
| 9,822,546 | B1 * | 11/2017 | Durham | E04H 15/62 |
| 9,879,801 | B2 * | 1/2018 | Wittmann | F16L 3/04 |
| 2017/0051527 | A1 * | 2/2017 | Dawson | E04H 15/62 |
| 2017/0058480 | A1 * | 3/2017 | Hermans | E02D 5/80 |

OTHER PUBLICATIONS

UST Brands Pegs, 8 pages, Dec. 31, 2017 [Internet accessed May 4, 2018].

* cited by examiner

*Primary Examiner* — Todd M Epps
(74) *Attorney, Agent, or Firm* — Stinson LLP

(57) ABSTRACT

A tie down stake and associated methods. The tie down stake is configured to mount on a second tie down stake in a storage configuration. Multiple tie down stakes can be chained to each other by releasable mounting connections formed by adjacent tie down stakes in the chain.

20 Claims, 7 Drawing Sheets

STOWABLE TIE DOWN STAKE

FIELD

The present disclosure generally relates to tie down stakes, and more particularly to tie down stakes configured to interface with each other to form a storage configuration.

BACKGROUND

Various types of tie down stakes are used for securing structures to the ground or other surfaces. For example, tie down stakes are used for securing structures such as tents, tarpaulins, canopies, signs, cables, straps, etc. to the ground. When driven into the ground, the stakes act as an anchor for securing the structure to the ground. When not in use, such stakes are commonly stored loose in a bag or pouch.

SUMMARY

In one aspect, a set of tie down stakes includes a first tie down stake and a second tie down stake. The first tie down stake includes a first elongate shaft having a proximal end portion, a distal end portion, and a longitudinal axis extending therebetween. The distal end portion is configured to be driven into a surface. A first head on the proximal end portion of the first shaft is configured to secure a first structure segment in position with respect to the surface. The second tie down stake includes a second elongate shaft having a proximal end portion, a distal end portion, and a longitudinal axis extending therebetween. The distal end portion is configured to be driven into the surface. A second head on the proximal end portion of the second shaft is configured to secure a second structure segment in position with respect to the surface. The first tie down stake and the second tie down stake each comprise mounting structure shaped to interface with each other to form a releasable, self-retaining mounting connection to mount the first tie down stake on the second tie down stake in a storage configuration.

In another aspect, a first tie down stake is stowable with a second tie down stake and a third tie down stake. The first tie down stake includes an elongate shaft having a proximal end portion and a distal end portion. The distal end portion is configured to be driven into a surface. A head on the proximal end portion of the shaft is configured to receive a cord to secure a first structure segment in position with respect to the surface. The head includes a protrusion configured to form a releasable, self-retaining mounting connection with a retainer of the second tie down stake to mount the first tie down stake on the second tie down stake for storage. The head includes a protrusion configured to form a releasable, self-retaining mounting connection with a retainer of the third tie down stake to mount the third tie down stake on the first tie down stake for storage.

In yet another aspect, a method is for storing tie down stakes. The method includes releasably mounting a first tie down stake on a second tie down stake by inserting a protrusion of the first tie down stake in a socket of the second tie down stake.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
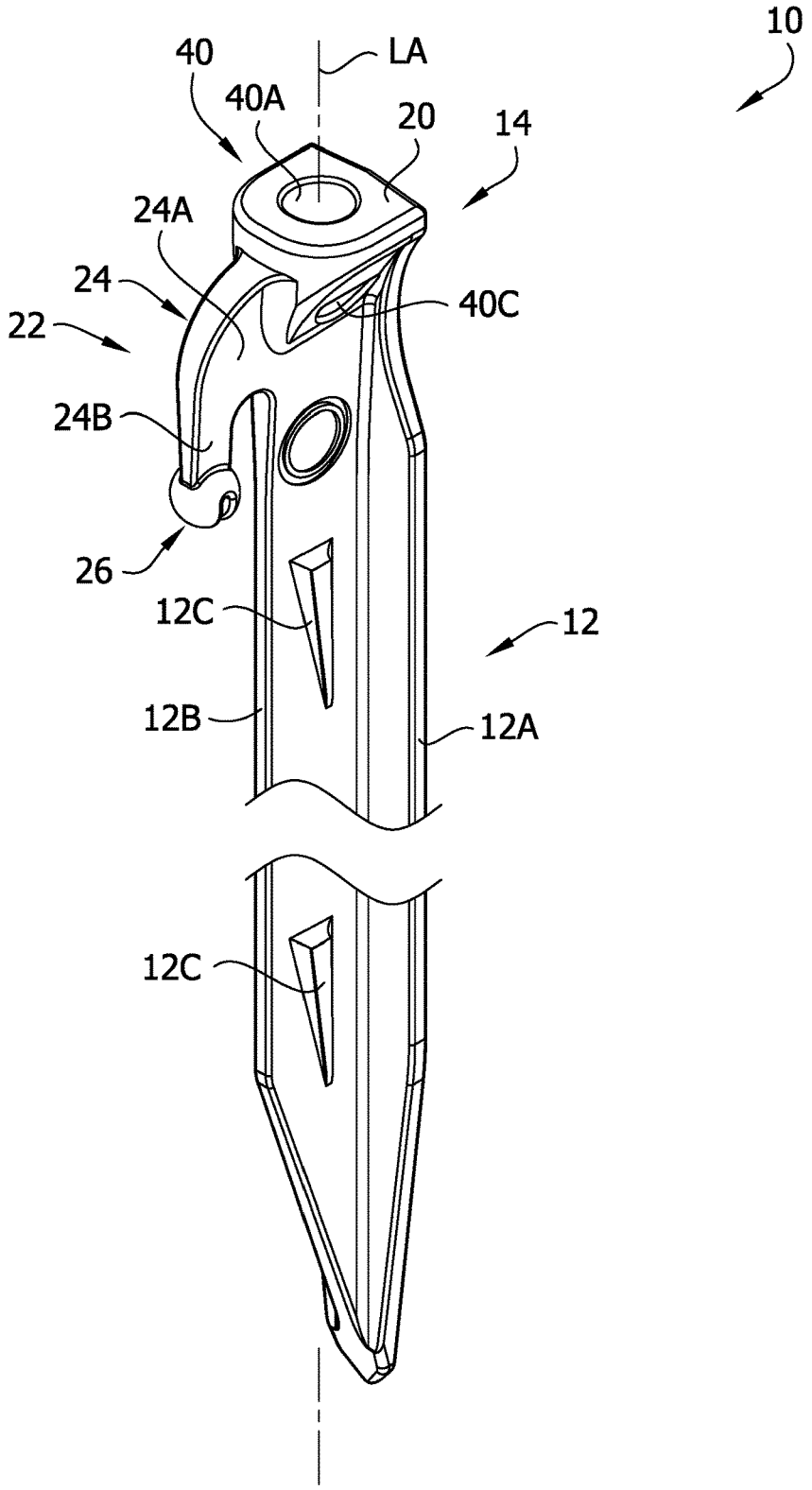
FIG. 1 is a perspective of a tie down stake.
Figure 2:
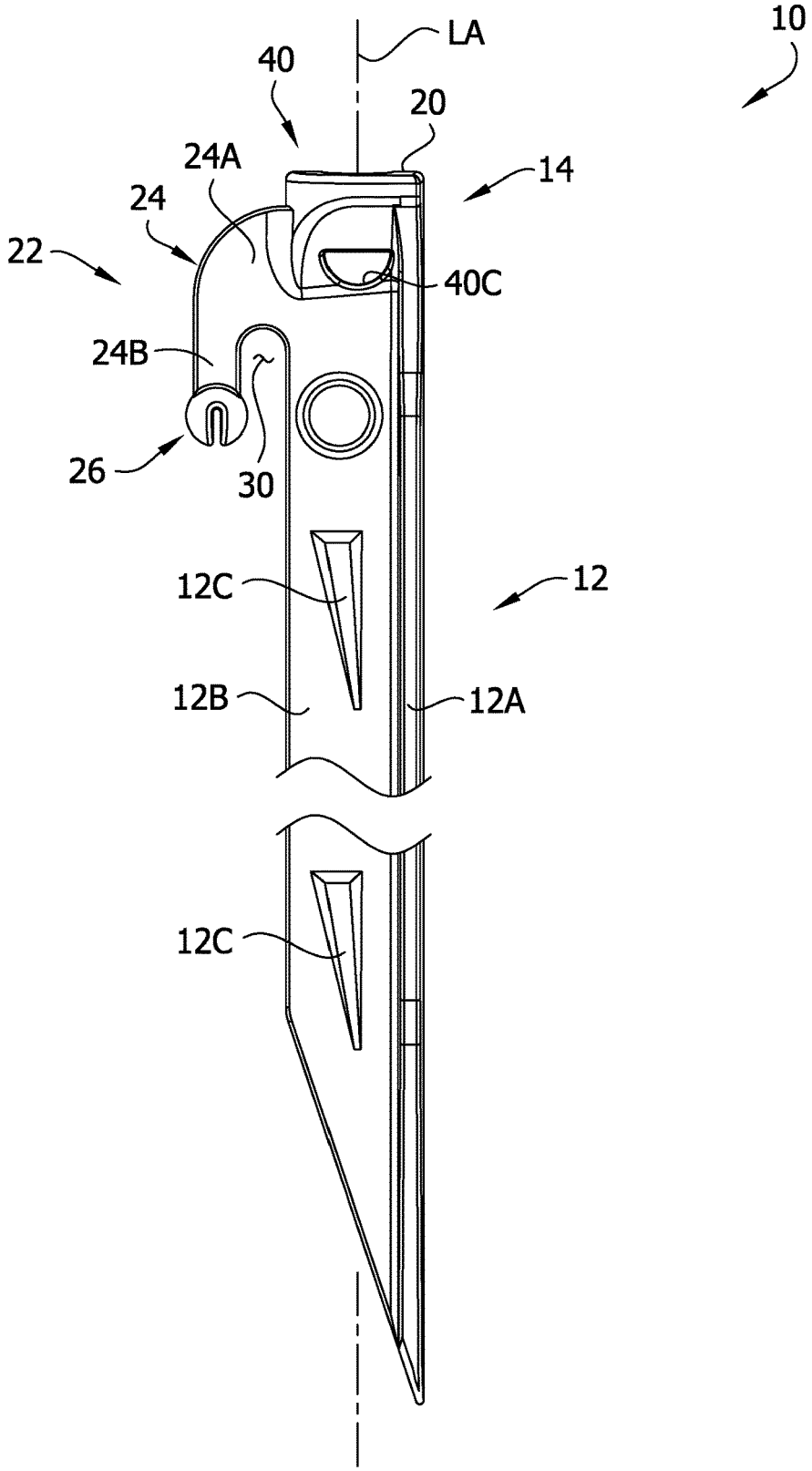
FIG. 2 is a side elevation of the tie down stake.

Referring to FIGS. 1 and 2, a tie down stake embodying aspects of the present invention is designated generally by the reference number 10. As explained in further detail below, the tie down stake 10 is configured to be driven into the ground to secure a structure in position with respect to the ground. For example, the tie down stake 10 can be used to anchor or tether a tent, tarpaulin, canopy, sign, strap, cord, or other structure to the ground. Multiple tie down stakes 10 may be used to anchor multiple segments of the structure or segments of different structures to the ground or another surface or surfaces.

The tie down stake 10 generally includes a shaft 12 and a head 14 on the shaft. The shaft 12 is configured to be driven into the ground, and the head 14 is configured to connect to the structure to be anchored by the stake 10. In the embodiment illustrated in FIGS. 1-4, the head 14 is integrally formed with the shaft 12. For example, the stake 10 can be formed of one piece of plastic or other suitable material. Other configurations can be used without departing form the scope of the present invention.

Referring to FIGS. 1 and 2, the shaft 12 has an elongate shape and includes a proximal end portion secured to the head 14 and a distal end portion opposite the proximal end portion. The shaft 12 has a length and longitudinal axis LA extending between the proximal and distal end portions. The shaft 12 can have any suitable length, such as a length in the inclusive range of 4 to 12 inches. The distal end portion includes a pointed tip configured to enter the ground. The shaft 12 has an intermediate section between the proximal end portion and the distal end portion. The distal end portion tapers distally from the intermediate section to the tip. The intermediate section has a generally constant width along its length and a T-shaped transverse cross-sectional shape that facilitates being driven into the ground. The shaft 12 includes an elongate main body 12A and an elongate flange 12B extending normal to the main body. The main body 12A and the flange 12B provide the shaft with its T-shaped transverse cross-sectional shape. Barbs 12C extend from opposite sides of the flange 12B to resist removal of the stake from the ground. Shafts having other configurations can be used without departing from the scope of the present invention.

In the illustrated embodiment, the head 14 includes a generally flat impact surface 20 against which the head is configured to receive one or more impacts to drive the shaft 12 into the ground. For example, a driving tool such as a hammer can be used to strike the impact surface 20 to drive the shaft 12 into the ground. Alternatively, a user may be able to push the shaft 12 into the ground by hand without striking the impact surface 20. In other embodiments, the shaft can be configured to be driven into the ground by rotation or other means.

The head 14 is configured to connect the tie down stake 10 to a structure to be anchored to the ground. In the illustrated embodiment, the head 14 includes a protrusion in the form of a hook 22 on which the structure can be held for connecting the structure to the stake 10. For example, the hook 22 can hold a tie such as a strap, cord, etc., which may itself be the structure to be anchored to the ground, or which may connect the stake to another structure (e.g., tent, canopy, tarpaulin, etc.) to be anchored to the ground. Alternatively, the hook 22 can be received in a grommet or other opening of the structure to be anchored. Many other arrangements are possible. The hook 22 includes an arm 24 and a boss 26 (broadly, "mounting structure"). The arm 24 has a first section 24A extending laterally from the proximal end portion of the shaft 12 and a second section 24B extending distally from the first section toward the distal end portion of the shaft. The boss 26 is secured to the second section 24B at the distal end of the arm 24. The boss 26 is provided in the form of a ball and may be referred to as a detent, for reasons which will become apparent. The hook 22 and shaft 12 define a gap 30 therebetween in which the structure to be anchored can be received. Other types of protrusions can be used without departing from the scope of the present invention.

Figure 3:
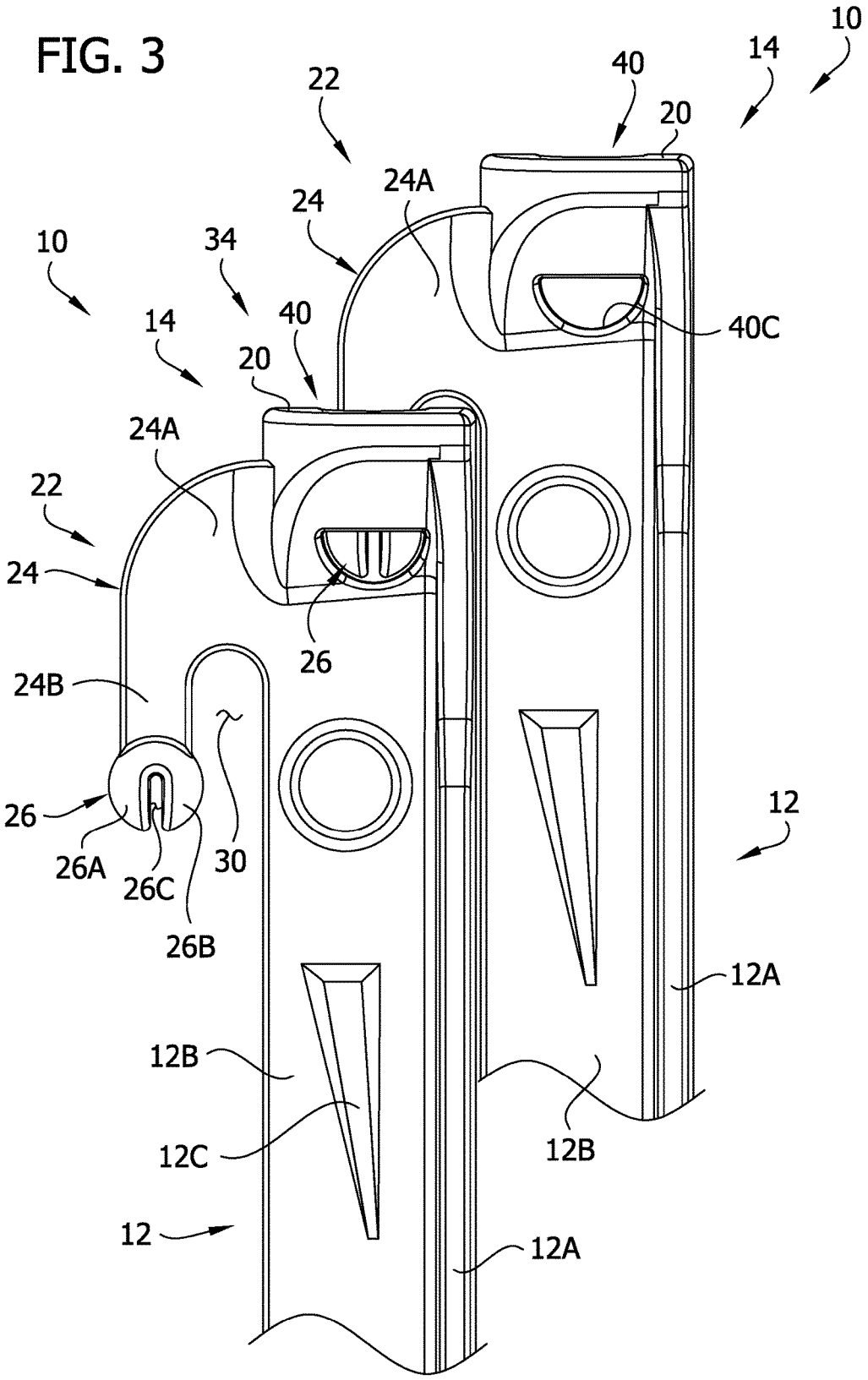
FIG. 3 is an enlarged, fragmentary side elevation of the tie down stake mounted on another tie down stake.
Figure 4:
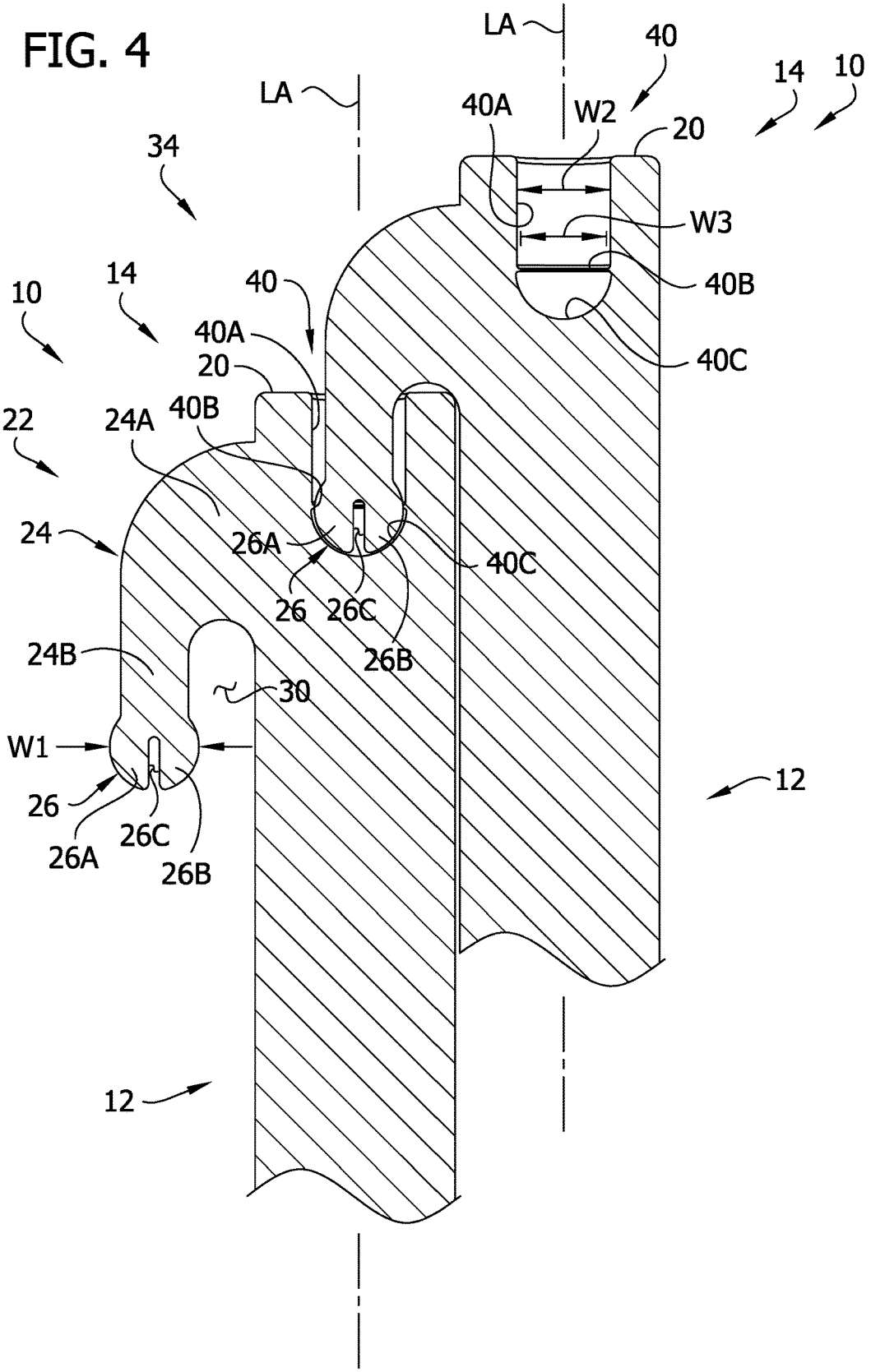
FIG. 4 is a view similar to FIG. 3 but showing the tie down stakes in section.

It will be appreciated that a set of tie down stakes 10 can include two, three, four, or more tie down stakes. A set of two tie down stakes 10 is shown in FIGS. 3 and 4. When the tie down stakes 10 are not in use, the tie down stakes can be stored together by mounting the tie down takes on each other to form a chain of tie down stakes in which releasable mounting connections 34 are made between adjacent tie down stakes in the chain. Each stake 10 is configured to connect to at least one other stake in a storage configuration. In the illustrated embodiment, each tie down stake 10 is configured to interface with two tie down stakes to form two releasable mounting connections 34. Each stake 10 includes a retainer 40 (broadly, "mounting structure") that can be interfaced with the hook 22 of another stake to form a first releasable, self-retaining mounting connection 34, and each stake includes the hook 22 that can be interfaced with the retainer 40 of another stake to form a second releasable mounting connection (not shown). One such releasable mounting connection 34 is shown in FIGS. 3 and 4. It will be readily apparent to a person of ordinary skill in the art that an infinite number of mounting connections may be formed in the same way as mounting connection 34.

In the illustrated embodiment, the retainer 40 is provided in the form of a socket in which the hook 22 (broadly, "protrusion") of another stake 10 is receivable. Referring to FIG. 4, the socket 40 includes a passage 40A having an inlet at the impact surface 20 of the head 14 and an outlet downstream from the inlet. The inlet faces upward away from the distal end portion of the shaft 12. Downstream from the inlet, the socket includes a lip 40B extending around the passage 40A at the outlet. The lip 40B protrudes inwardly relative to the passage side wall and defines a round opening having a reduced width through which the boss 26 is movable. The illustrated lip 40B is a continuous bead or rib extending inward relative to the wall of the passage 40A. The passage 40A opens to a recess 40C in the head 14 past the lip 40B. The recess 40C opens out of opposite sides of the head 14. Sockets having other configurations can be used without departing from the scope of the present invention. For example, retainers having other retaining structures (e.g., lips having other configurations, etc.) can be used. The lip does not need to be continuous around the passage or be arcuate or round.

The boss 26 is sized to be freely slidable in the passage 40A from the inlet to the lip 40B and to engage the lip 40B to retain the boss in the socket 40. Referring to FIG. 4, the boss 26 has a width W1 slightly less than a width W2 of the passage from the inlet to the lip 40B, permitting the boss to freely slide from the inlet to the lip. The width W1 of the boss 26 is slightly greater than the width W3 of the passage 40A at the lip 40B. The boss 26 includes a first section 26A and a second section 26B separated by a gap 26C. The first and second sections 26A, 26B of the boss 26 have rounded outer surfaces and are resiliently deflectable toward each other to decrease the gap 26C such that the boss defines a resiliently deformable ball shaped connector. The boss 26 is sized to engage the lip 40B to cause the boss to resiliently deform from an at rest configuration to decrease the width of the boss. As the rounded or tapered outer surfaces of the first and second boss sections 26A, 26B slide downward against the lip 40B, the first and second sections progressively move closer to each other, reducing the width of the gap 26C. The gap 26C extends from a distal end of the boss toward a proximal end of the boss beyond an intermediate portion of the boss where the boss has its maximum width W1. After the intermediate portion of the boss 26 passes the lip 40B, the boss resiliently expands (e.g., completely or partially to its previous at rest configuration) and assumes a self-retaining position in the socket 40. The boss 26 forms an interference fit with the lip 40B to retain the boss in the socket 40. The connection of the boss 26 in the socket 40 may also be referred to as a ball and socket connection and/or a detent arrangement. Moreover, the connection can be referred to as a "snap" connection in which the boss snaps into releasable mounted position in the socket. Other types of releasable mounting connections can be used without departing from the scope of the present invention. For example, other types of interference fits, detent arrangements, and/or snap connections can be used.

It will be appreciated that multiple stakes 10, such as three, four, five, six, etc. stakes can be chained together by forming releasable mounting connections 34 to form a chain of stakes in which all of the shafts 12 are generally parallel to each other and longitudinally offset from one another. As shown in FIGS. 3 and 4, when two stakes 10 are in the storage configuration (forming the releasable mounting connection 34), the shafts 12 of the stakes extend generally alongside each other and are longitudinally offset from one another. The releasable mounting connection 34 is configured to maintain the stakes 10 in this general orientation. It will be appreciated that pivoting the longitudinal axis LA of one stake 10 relative to the longitudinal axis of the other stake is limited by engagement of the protrusion 22 in the socket 40 and by engagement of the shafts 12 against each other. In particular, when the boss 26 is in the retained position in the socket 40, engagement of the arm 24 against surfaces of the passage 40A prevents substantial pivoting of the longitudinal axes LA of the stakes 10 with respect to each other about the releasable mounting connection 34. The head 14 of the mounted tie down stake 10 may also engage the other tie down stake under the mounting arm 24 to further limit movement of the tie down stakes with respect to one another. Desirably, the arrangement is such that when the tie down stakes 10 are in the storage configuration, the tie down stakes are nested together and supported against substantial rotation with respect to one another. The releasable mounting connection 34 is desirably a substantially rigid connection but may permit some movement of the stakes 10. For example, the releasable mounting connection 34 may be configured to prevent rotation of a longitudinal axis LA of one stake to form and angle greater than about 10 degrees, 15 degrees, 20 degrees, 25 degrees, 30 degrees, 35 degrees, or 40 degrees from parallel with the longitudinal axis LA of the other stake. In other words, the releasable mounting connection 34 may be configured to maintain the longitudinal axes LA of the shafts 12 oriented with respect to each other between parallel and about 10 degrees off parallel, between parallel and about 20 degrees off parallel, between parallel and about 25 degrees off parallel, between parallel and about 30 degrees off parallel, between parallel and about 35 degrees off parallel, or between parallel and about 40 degrees off parallel.

In a method of using the tie down stakes 10, the tie down stakes can be driven into the ground or another surface where it is desired to anchor a structure. Multiple stakes 10 can be used to anchor multiple segments of the structure or anchor different structures. When the stakes 10 are no longer needed, the stakes can be removed from the ground and arranged in the storage configuration. A first stake 10 is mounted on a second stake 10 by inserting the hook 22 of the first stake in the socket 40 of the second stake. A third stake (not shown) is mounted on the first stake 10 by inserting the hook of the third stake in the socket 40 of the first stake. The process can be repeated as many times as needed to chain all of the stakes 10 of a set together. To form each releasable mounting connection 34, the shafts 12 of the two stakes are arranged alongside each other with the boss 26 adjacent the inlet of the respective socket 40. Then the boss 26 is moved in a connecting (first) direction generally parallel with the longitudinal axis LA of the shaft 12 to insert the boss into the socket 40 to the self-retaining position with respect to the lip 40B. The boss 26 resists passing the lip 40B until sufficient force is applied in the first direction to cause the boss to deform from its at rest configuration to reduce the width of the boss. When sufficient force is applied, the boss 26 automatically deforms in response to engagement with the lip 40B, and moves to its retained position. The boss 26 is then obstructed from removal from the socket 40 by the lip 40B. The detent arrangement of the boss 26 in the socket 40 resists release of the releasable mounting connection 34. The protrusion 22 and retainer 40 (broadly, "connectors") are integrally formed with and carried by the stakes 10 so no additional components are needed to secure the stakes to each other in the storage configuration. The stakes 10 are conveniently held together as a group by releasable, self-retaining connections 34 formed by the stakes themselves. Thus, the connected stakes can be turned at any orientation, dropped, or otherwise subjected to incidental forces without becoming disconnected. When it is desired to use the stakes 10 again, the stakes are disconnected from each other by forcing the bosses 26 out of the sockets 40. A user applies force to the stakes tending to move the boss 26 in a disconnecting (second) direction opposite the connecting direction. The boss 26 initially resists deforming until sufficient force is applied to cause the boss to deform to pass the lip 40B, which permits the stakes 10 to be readily separated from each other. This process is repeated until all of the stakes are disconnected.

Other types of releasable mounting connections can be used without departing from the scope of the present invention. For example, other types of protrusions and other types of retainers can be used, and the connection need not include a deformable connector. Moreover, instead of the protrusion being deformable for forming the releasable mounting connection, the retainer can be deformable, or the protrusion and retainer can be deformable.

Figure 5:
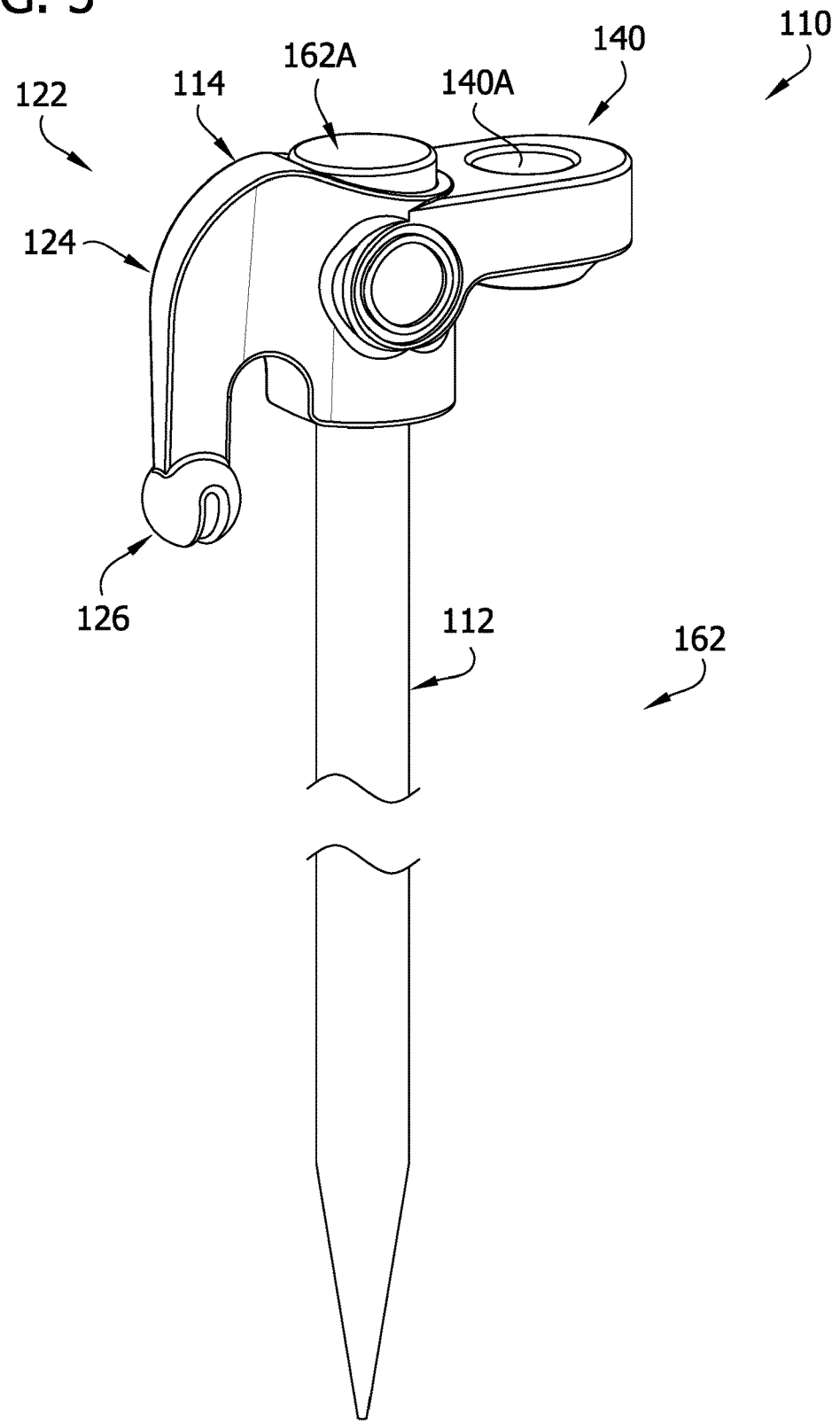
FIG. 5 is a perspective of a second embodiment of a tie down stake.
Figure 6:
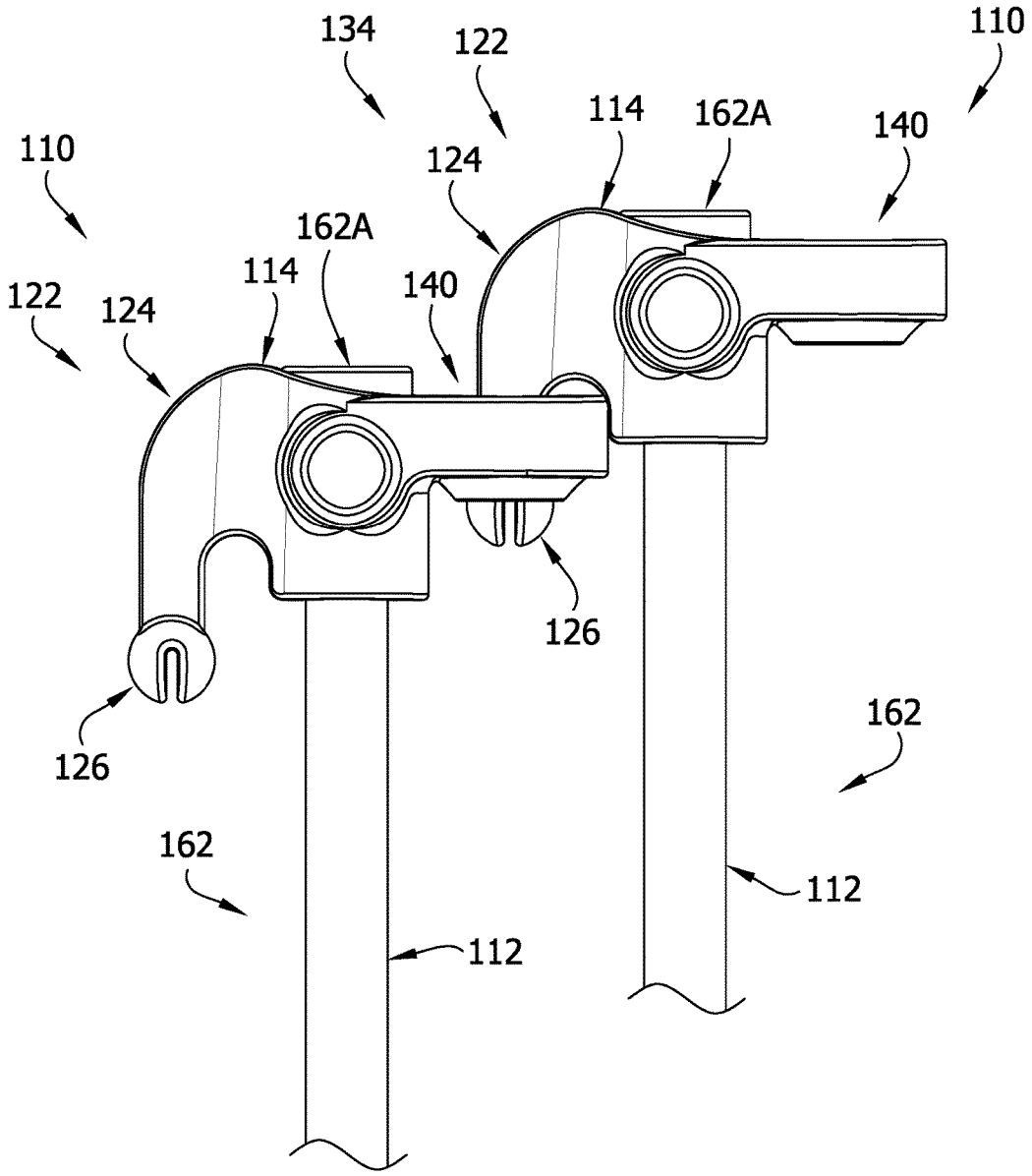
FIG. 6 is an enlarged, fragmentary side elevation of the tie down stake of FIG. 5 mounted on another tie down stake.
Figure 7:
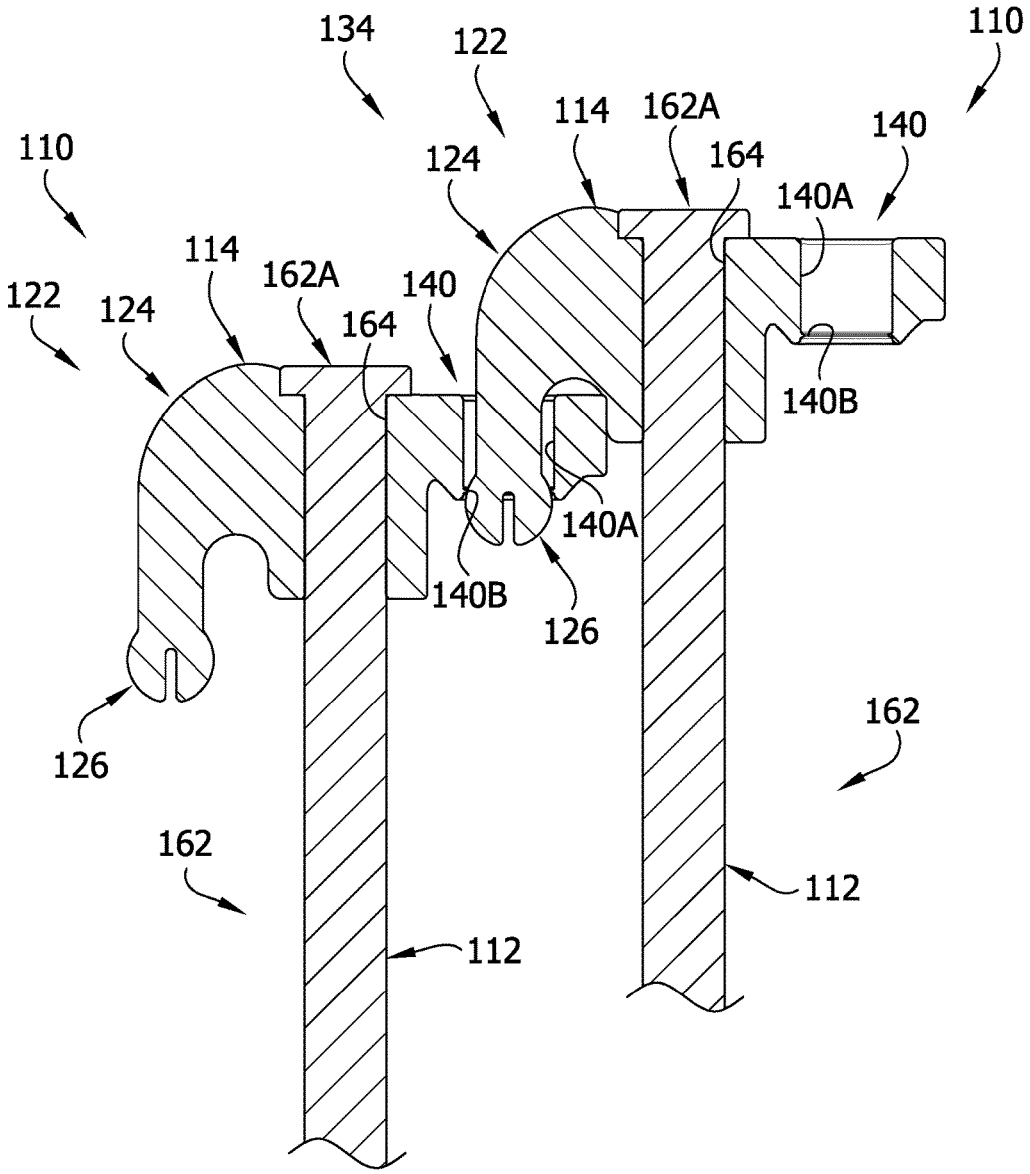
FIG. 7 is a view similar to FIG. 6 but showing the tie down stakes in section.

Referring to FIGS. 5-7, a second embodiment of a tie down stake is designated generally by the reference number 110. The tie down stake 110 is similar to the tie down stake 10 of the first embodiment, and similar parts are designated by similar reference numbers, plus 100. For example, the tie down stake 110 includes an elongate shaft 112 and a head 114 secured to the shaft. In this embodiment, the head 114 is formed separately from the shaft 112. The head 114 can be formed of plastic, and the shaft 112 can be formed of metal. Other suitable materials can be used. In this embodiment, the shaft 112 is part of a peg or nail 162 and is received through an opening 164 in the head 114. The peg 162 includes a head 162A that abuts the stake head 114 around an edge margin of the opening 164 to locate the shaft 112 with respect to the stake head 114. The opening 164 may also be sized to provide a friction fit of the shaft 112 in the opening.

As in the first embodiment, the stake 110 of this embodiment is configured to form releasable mounting connections 134 with other stakes for storage. Two stakes 110 are shown connected to each other in FIGS. 6 and 7. Each stake 110 includes a protrusion in the form of a hook 122 including an arm 124 and a resiliently deformable boss 126. Each stake 110 also includes a retainer in the form of a socket 140 including a passage 140A and a lip 140B in the passage. In this embodiment, the head 114 does not define a recess downstream from the lip 140B. Instead, the boss 126 protrudes beneath the head 114 when in the retained position. Moreover, the socket 140 is not formed in the impact surface at the stake 110. Instead, the socket 140 is formed in part of the head 114 next to the impact surface, and part of the shaft 112 forms the impact surface. Formation of the releasable, self-retaining mounting connection 134 is performed in the same method as described above with respect to the first embodiment. The engagement of the heads 114 against each other (e.g., boss 126 against lip 140B, arm 124 against wall of passage 140A, etc.) maintains the stakes 110 in a storage configuration in which the shafts 112 extend generally alongside each other and are longitudinally offset with respect to each other.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A set of tie down stakes comprising:

a first tie down stake comprising:

a first elongate shaft having a proximal end portion, a distal end portion, and a longitudinal axis extending therebetween, the distal end portion being configured to be driven into a surface; and a first head on the proximal end portion of the first shaft, the first head being configured to secure a first structure segment in position with respect to the surface; and a second tie down stake comprising:

a second elongate shaft having a proximal end portion, a distal end portion, and a longitudinal axis extending therebetween, the distal end portion being configured to be driven into the surface; and a second head on the proximal end portion of the second shaft, the second head configured to secure a second structure segment in position with respect to the surface;

wherein the first tie down stake and the second tie down stake each comprise mounting structure shaped to interface with each other to form a releasable, self-retaining mounting connection to mount the first tie down stake on the second tie down stake in a storage configuration.

2. The set of tie down stakes as set forth in claim 1, wherein in the storage configuration the first and second elongate shafts extend generally alongside each other.

3. The set of tie down stakes as set forth in claim 1, wherein when the releasable, self-retaining mounting connection is formed, the shafts of the first and second tie down stakes are longitudinally offset.

4. The set of tie down stakes as set forth in claim 1, wherein the mounting structures form a detent arrangement configured to resist release of the releasable, self-retaining mounting connection.

5. The set of tie down stakes as set forth in claim 4, wherein the mounting structure of the first tie down stake includes a detent and the mounting structure of the second tie down stake includes a lip configured to obstruct the detent when the releasable, self-retaining mounting connection is formed to resist release of the releasable, self-retaining mounting connection.

6. The set of tie down stakes as set forth in claim 1, wherein the mounting structure of the first tie down stake is configured to be interfaced with the mounting structure of the second tie down stake in a first direction to form said releasable, self-retaining mounting connection, and when said releasable, self-retaining mounting connection is made the releasable, self-retaining mounting connection resists movement of the first tie down stake in a second direction opposite the first direction tending to dismount the first tie down stake from the second tie down stake.

7. The set of tie down stakes as set forth in claim 1, further comprising a third tie down stake and a fourth tie down stake, wherein said releasable, self-retaining mounting connection is a first releasable, self-retaining mounting connection, the mounting structure of the first tie down stake being shaped and arranged to form a second releasable, self-retaining mounting connection with the third tie down stake to mount the third tie down stake on the first tie down stake, and the mounting structure of the second tie down stake being shaped and arranged to form a third releasable, self-retaining mounting connection with the fourth tie down stake to mount the second tie down stake on the fourth tie down stake.

8. The set of tie down stakes as set forth in claim 1, wherein the mounting structure of the first tie down stake includes a resiliently deformable connector that interfaces with the mounting structure of the second tie down stake to form said releasable mounting connection and is configured to deform to form said releasable mounting connection.

9. The set of tie down stakes as set forth in claim 1, wherein the mounting structure of the first tie down stake includes a resiliently deformable connector that interfaces with the mounting structure of the second tie down stake to form said releasable, self-retaining mounting connection, the resiliently deformable connector configured to maintain the releasable, self-retaining mounting connection against a first force in a first direction on the first tie down stake tending to release the releasable, self-retaining mounting connection, and the resiliently deformable connector configured to automatically deform responsive to a second force on the first tie down stake in the first direction greater than the first force to permit release of the releasable, self-retaining mounting connection.

10. The set of tie down stakes as set forth in claim 1, wherein the mounting structure of the first head includes a protrusion and the mounting structure of the second head includes a retainer, the protrusion being configured to interface with the retainer to form said releasable, self-retaining mounting connection.

11. The set of tie down stakes as set forth in claim 10, wherein the releasable, self-retaining mounting connection includes an interference fit formed by the protrusion and retainer.

12. The set of tie down stakes as set forth in claim 10, wherein at least one of the protrusion and the retainer is resiliently deformable and is configured to deform to form said interference fit.

13. The set of tie down stakes as set forth in claim 10, wherein the retainer comprises a socket, the protrusion being releasably receivable in the socket to form said releasable mounting connection.

14. The set of tie down stakes as set forth in claim 13, wherein the protrusion comprises a ball releasably receivable in the socket to form said releasable mounting connection.

15. The set of tie down stakes as set forth in claim 10, wherein the retainer comprises an opening in the second head, the protrusion being receivable in the opening to form the releasable mounting connection.

16. The set of tie down stakes as set forth in claim 15, wherein the opening in the second head faces in a direction opposite the distal end portion of the second shaft.

17. The set of tie down stakes as set forth in claim 16, wherein the second head includes an impact surface against which the head is configured to receive an impact to drive the second shaft into the surface, and the opening is in the impact surface.

18. A first tie down stake stowable with a second tie down stake and a third tie down stake, the first tie down stake comprising:

an elongate shaft having a proximal end portion and a distal end portion, the distal end portion being configured to be driven into a surface, and a head on the proximal end portion of the shaft, the head being configured to receive a cord to secure a first structure segment in position with respect to the surface, the head including a protrusion configured to form a releasable, self-retaining mounting connection with a retainer of the second tie down stake to mount the first tie down stake on the second tie down stake for storage, the head including a protrusion configured to form a releasable, self-retaining mounting connection with a retainer of the third tie down stake to mount the third tie down stake on the first tie down stake for storage.

19. The first tie down stake as set forth in claim 18, in combination with the second and third tie down stakes.

20. A method of storing tie down stakes, the method comprising:

releasably mounting a first tie down stake on a second tie down stake by inserting a protrusion of the first tie down stake in a socket of the second tie down stake.

* * * * *